US006669209B2

(12) United States Patent
Furzer et al.

(10) Patent No.: US 6,669,209 B2
(45) Date of Patent: Dec. 30, 2003

(54) HEATING ARRANGEMENT FOR ICE SKATE BLADES

(75) Inventors: Jeremy Furzer, Sherwood Park (CA); Tory Weber, Sherwood Park (CA)

(73) Assignee: Therma Blade Inc., Alberta (CA)

( * ) Notice: Subject to any disclaimer, the term of this patent is extended or adjusted under 35 U.S.C. 154(b) by 5 days.

(21) Appl. No.: 10/015,221

(22) Filed: Dec. 12, 2001

(65) Prior Publication Data

US 2003/0107192 A1 Jun. 12, 2003

(51) Int. Cl.[7] ..... A63C 1/00
(52) U.S. Cl. ..... 280/11.12; 219/201; 219/211
(58) Field of Search ..... 280/11.12, 11.14, 280/11.18, 841; 36/2.6, 119; 219/201, 209, 211, 482, 507, 527

(56) References Cited

U.S. PATENT DOCUMENTS 3,119,921 A * 1/1964 Czaja ..... 219/201
3,866,927 A * 2/1975 Tvengsberg ..... 280/11.12
4,034,489 A * 7/1977 Hughes, Jr. ..... 37/230
5,441,305 A * 8/1995 Tabar ..... 280/809
5,973,293 A * 10/1999 Reichman ..... 219/211
6,229,132 B1 * 5/2001 Knetter ..... 219/759

* cited by examiner

*Primary Examiner*—Brian L. Johnson
*Assistant Examiner*—J. Allen Shriver
(74) *Attorney, Agent, or Firm*—Adrian D. Battison; Michael R. Williams; Ryan W. Dupuis

(57) ABSTRACT

An ice skate comprising a boot arranged to receive a person's foot, a skate blade assembly and a blade heating arrangement mounted within a blade mounting arrangement. The blade heating arrangement is arranged to use a field-effect transistor controlled by a microprocessor to operate in the non-linear range to heat skate blades from a power source.

12 Claims, 4 Drawing Sheets

HEATING ARRANGEMENT FOR ICE SKATE BLADES

FIELD OF THE INVENTION

The present invention relates to a heating arrangement for ice skate blades.

BACKGROUND

Common ice skates used in skating have a elongate blade which is arranged to slide along the ice surface. Attempts to minimise the friction between the blade and the ice using heat are shown in U.S. Pat. No. 3,119,921 (Czaja) and U.S. Pat. No. 3,866,927 (Tvengsberg) which use resistance heating to heat a blade on a skate. Resistance heating uses a high amount of energy and providing enough power to maintain a heated blade for a sufficient length of time would need a large power source. Since the optimal situation is to have a light skate, the above examples would be relatively heavy and cumbersome to use, specifically in prolonged uses.

SUMMARY

It is an object of the present invention to provide an ice skate including a heating system which reduces the coefficient of friction of the blade on the ice.

According to an aspect of the present invention there is provided an ice skate comprising;

a boot arranged to receive a persons foot;

a skate blade assembly having;

a blade mounting arrangement is arranged to be connected to a sole of the boot and arranged to support a skate blade thereon, and;

a blade heating arrangement mounted within the mounting arrangement having a processor and a power source;

wherein the blade heating arrangement uses a field-effect transistor operating in its non-linear region of operation to heat the skate blade.

Conveniently the blade heating arrangement has a motion sensor arranged to control the heating of the blade such that when the skate is in use the blade is heated, when the skate is not in use the heat is off.

Conveniently the blade has sides which are insulated by a plastic material to provide an insulating layer between the blade and the air.

Conveniently the insulating layer is Polytetrafluoroethylene (PTFE).

Preferably the processor is a RISC processor.

Preferably the processor senses the temperature of the skate blade.

Conveniently there are three distinct heating states controlled by the processor, initial warm up, full maintain which is activated when the skate is in constant action and a half maintain which is activated when the skate is in use occasionally.

Preferably the heating arrangement is specifically tuned for skate blade geometry and metallurgy.

Preferably the microprocessor is used to generate a continuously adapting drive waveform.

Preferably the power source is a rechargeable lithium battery mounted within the blade mounting arrangement.

BRIEF DESCRIPTION OF THE DRAWINGS

In the accompanying drawings, which illustrate an exemplary embodiment of the present invention.

DETAILED DESCRIPTION

Figure 1:
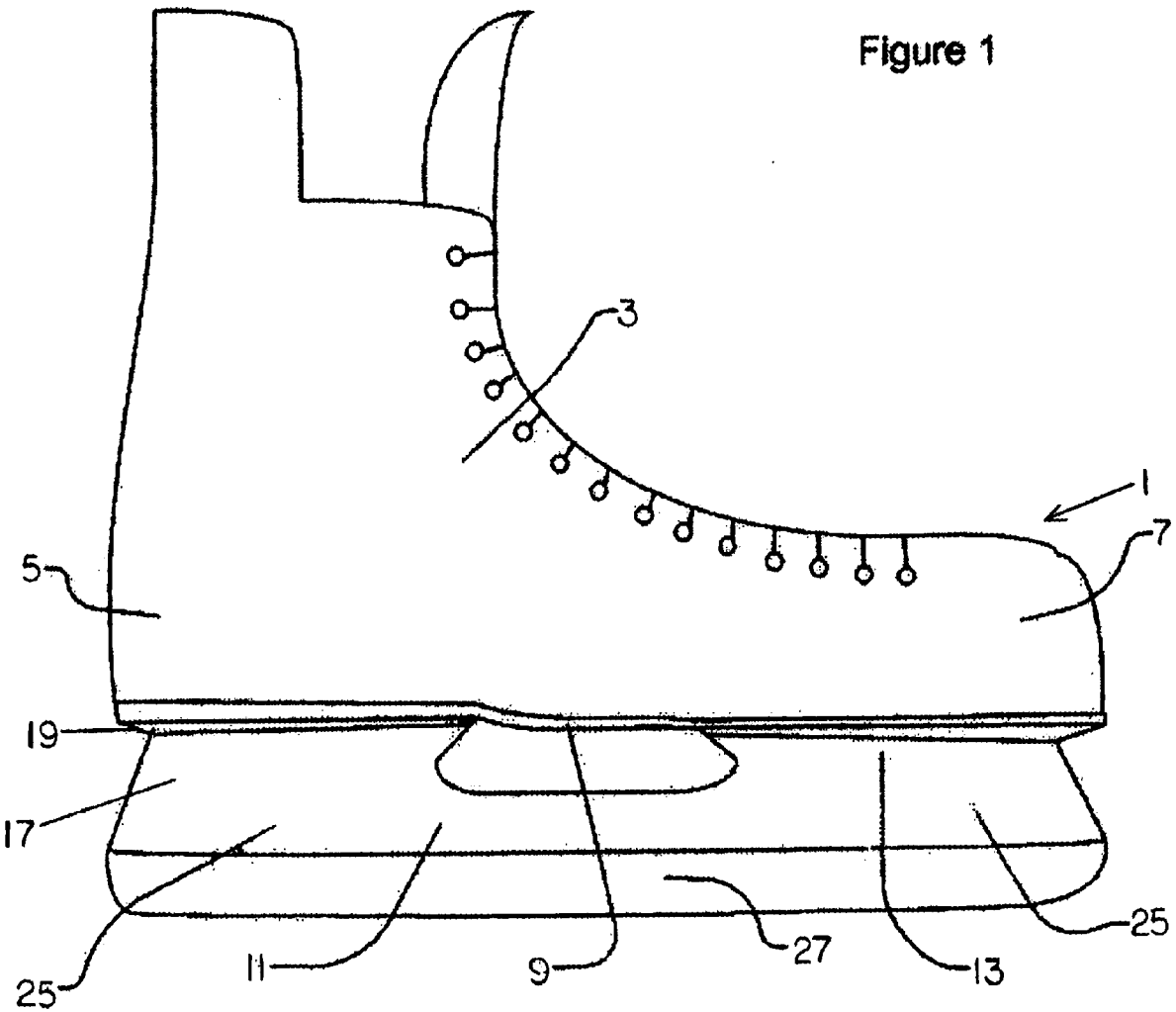
FIG. 1 is a side view of the present invention.
Figure 2:
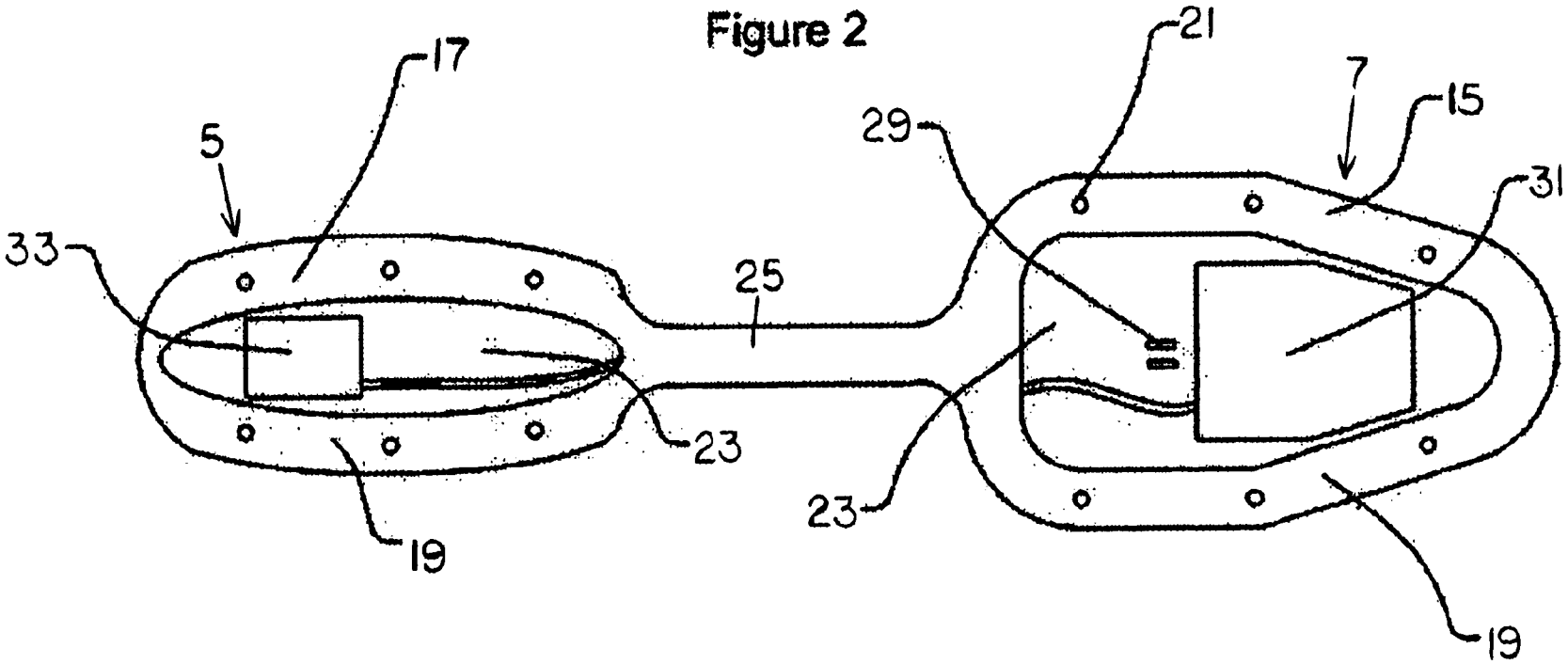
FIG. 2 is a cross section along the lines 2—2 of FIG. 1 showing the circuit board and power supply.

Referring to the accompanying drawings, there is illustrated ice skate 1. The skate is of the conventional ice hockey skate type having a boot 3 shaped and arranged to support a person's foot therein. The boot has a heel 5, toe 7 and a sole 9. Attached to the bottom side of the sole is a skate blade assembly 11. The skate blade assembly has a mount portion 13 which is generally riveted to the bottom of the sole. The mount portion, as in a convention ice hockey skate, has a first mount section 15 arranged to mount at the toe and a second mount section 17 arranged to mount at the heel. Each mount section has an outer flange 19 which is arranged to conform to the sole and is connected to the sole by rivets inserted through rivet holes 21 and into the bottom of the sole. Each section has a hollow interior 23, as in conventional ice hockey skates, for minimum weight. A blade mount 25 connected at each end to a respective mount section and is arranged to support a blade 27 therein.

A heating arrangement 29 is arranged to use a microprocessor controlled heating circuit to heat the blade such that the heat reduces the coefficient of friction of the blade on an ice surface. The heating arrangement has a circuit board 31 and battery 33 mounted within the hollow interior of the mount section adjacent the heel.

Figure 3:
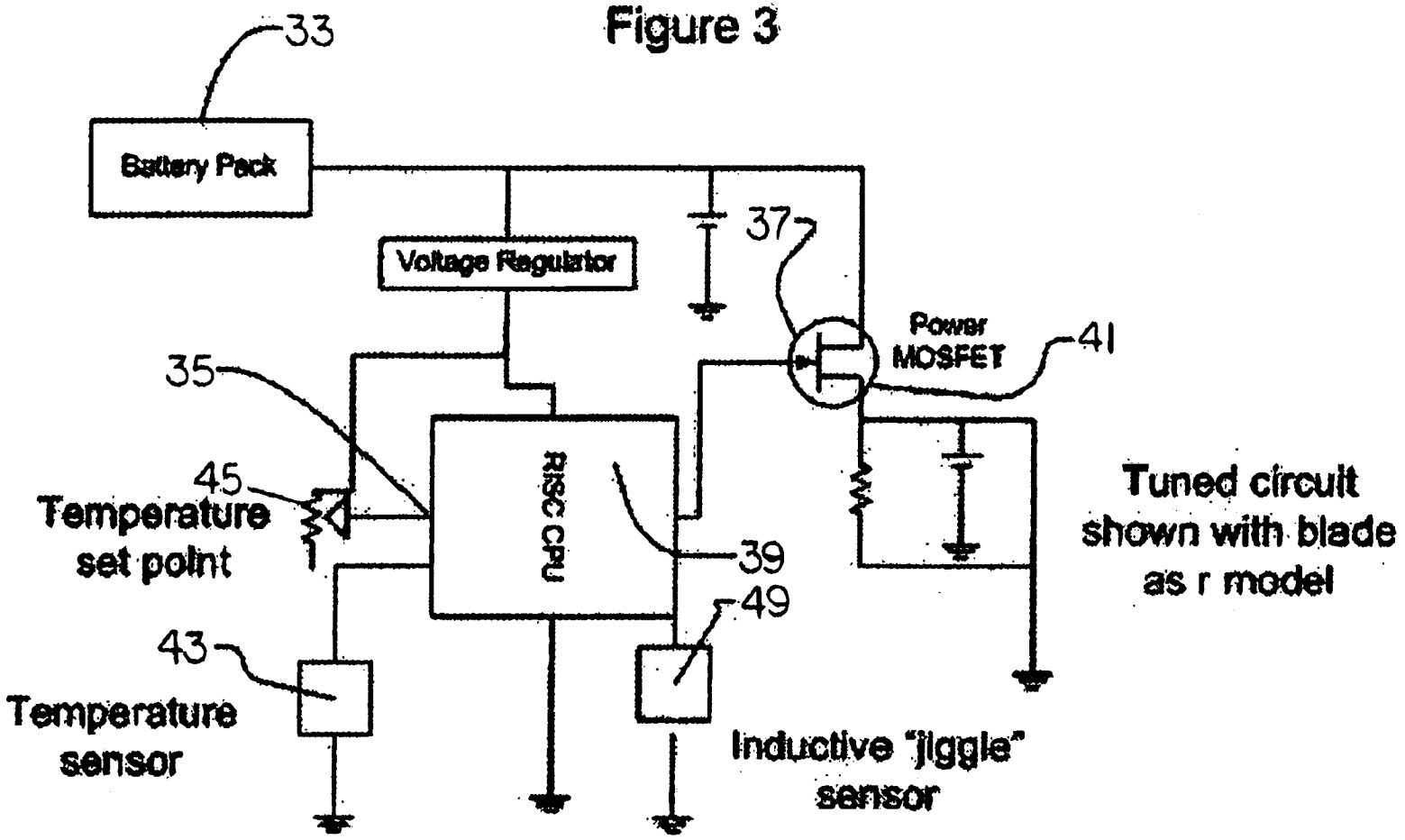
FIG. 3 is a schematic illustration of the circuit.
Figure 4:
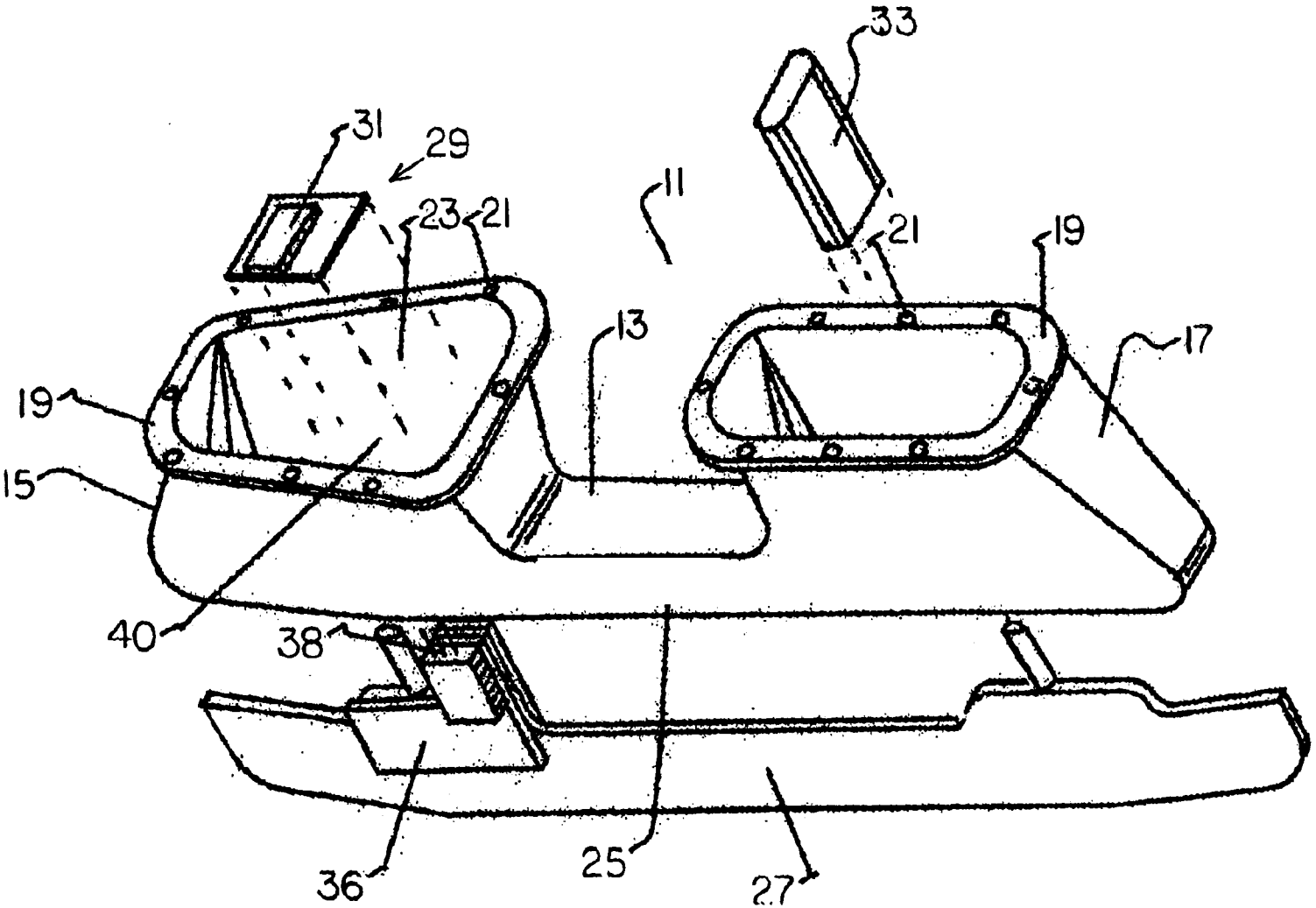
FIG. 4 is a exploded isometric view of the present invention.

The circuit, as illustrated in FIG. 3, has a microprocessor 35 which controls the temperature of the blade. The microprocessor has an automatic sensing which senses when the heat to the blade should be turned on or off. During heating there are three distinct states, initial warm-up, which is an accelerated heating of the skate blade. Full maintain, which is when the skate blade is likely in play and in contact with an ice surface and half maintain which is when a skate blade is on but not likely in contact with an ice surface. The microprocessor output is specifically tuned for skate blade geometry and metallurgy. A brass plate 36 is coupled to the skate blade through which the energy is transferred from the heating circuit to heat the skate blade. The brass plate engages respective sides of the skate blade and, as best shown in FIG. 4, is arranged to be concealed within the blade mounting arrangement adjacent the heating circuit. A female connector 38 extends from the brass plate and is arranged to extend into the hollow interior and connect to a male connector 40 on the circuit. The heating circuit is designed specifically for this application. The skate blade is coated on the side surfaces with Polytetrafluoroethylene (PTFE) to provide an insulating layer between the blade and the air. The PTFE coating also serves to minimise incrustation and build-up of ice on the sides of the blade.

The heating circuit operates by taking a semiconductor 37 into the non-linear region of operation and tuning for appropriate parasites a high frequency, high efficiency heat source that operates with minimal radio frequency leakage is produced. The use of a blade as part of the tuned load as well as the heat sink permits dynamic tuning as a function of the target's current thermal/electrical resistance. As the self-destruct region of the heating circuit is easily reached in the configuration a RISC microprocessor 39 is used to generate a continuously adapting drive waveform. Additionally, the processor 39 also manages the on-off, temperature status and battery condition modules.

The battery is a rechargeable lithium ion battery preferably configured as a ~7.2 v @ 4400 ma hours is regulated for circuit operation and used to supply as the semiconductor 37, an n-channel power mos-fet semiconductor or field-effect transistor 41. This power mos-fet or field-effect transistor is supplied a buffered and shaped ~3.5 v clock by the RISC microprocessor. The resultant bias is used to operate a tuned snubbing network.

A semiconductor temperature sensor 43 and an adjustable resistor 45 are used to control blade temperature. The temperature is adjustable from 0° C. to 80° C.

Motion input to control on, off, warm-up, maintain and half maintain are controlled by a jiggle sensor 49.

The processor is configured to operate at 1 mghz, offering a 1 $\mu$s instruction cycle. A 1 $\mu$s quantum is used to synthesise a complex, 22 $\mu$s period waveform that is delivered to the power semiconductor 37. This waveform drives the power semiconductor 37 in a cycle that centers on a 2.03 ms window. At the start of a 2.03 ms period a series of 22 $\mu$s pulses are generated, the frequency of determined by the state of the heat high/low bit. At end of cycle (2.03 ms) minus (8×22 $\mu$s)+(9/clk_current_count×1 $\mu$s) five to eight 22 $\mu$s pulses are generated on a long curve.

Temperature sensor input is compared to the resistive reference by an analogue comparator. When the input crosses the reference (in either direction) an interrupt routine services the thermal input and determines the appropriate state of the high/low bit.

A motion sensor input from the sensor 49 is used by the processor to activate, shutdown or "sleep" the system. Essentially these routines consist of three timer/counters that track the on time, the last time a motion input was received and time between the latest two motion inputs.

While one embodiment of the present invention has been described in the foregoing, it is to be understood that other embodiments are possible within the scope of the invention. The invention is to be considered limited solely by the scope of the appended claims.

What is claimed is:

1. An ice skate comprises:

a boot arranged to receive a persons foot;

a skate blade assembly having;

a blade mounting arrangement is arranged to be connected to a sole of the boot and arranged to support a skate blade thereon, and;

a blade heating arrangement mounted within the mounting arrangement having a microprocessor and a battery power source;

wherein the blade heating arrangement uses a field-effect transistor controlled by the microprocessor to operate in the non-linear range to heat the skate blade.

2. The skate according to claim 1 wherein the blade heating arrangement has a motion sensor arranged to control the heating of the blade such that when the skate is in use the blade is heated, when the skate is not in use the heat is off.

3. The skate according to claim 1 wherein the blade has sides which are insulated by a plastic material to provide an insulating layer between the blade and the air.

4. The skate according to claim 3 wherein the insulating layer is polytetrafluoroethylene.

5. The skate according to claim 1 wherein the microprocessor is a RISC processor.

6. The skate according to claim 1 wherein the microprocessor includes a transducer which senses the temperature of the skate blade.

7. The skate according to claim 1 wherein there are three distinct heating states controlled by the microprocessor, initial warm up, full maintain which is activated when the skate is in constant action and a half maintain which is activated when the skate is in use occasionally.

8. The skate according to claim 1 wherein the output of the microprocessor is specifically tuned for skate blade geometry and metallurgy.

9. The skate according to claim 1 wherein the microprocessor is used to control the field-effect transistor by generating a continuously adapting drive waveform.

10. The skate according to claim 1 wherein the battery power source is a high performance rechargeable lithium battery.

11. The skate according to claim 1 wherein a heat transfer plate is mounted on the blade through which the heating arrangement transmits heat to heat the skate blade.

12. The skate according to claim 11 wherein the heat transfer plate is mounted to the blade such that the heat transfer plate is concealed within the blade mounting arrangement.

* * * * *